US007032846B1

(12) United States Patent
Heyse

(10) Patent No.: US 7,032,846 B1
(45) Date of Patent: Apr. 25, 2006

(54) FUEL INJECTION VALVE

(75) Inventor: Joerg Heyse, Besigheim (DE)

(73) Assignee: Robert Bosch GmbH, Stuttgart (DE)

( * ) Notice: Subject to any disclaimer, the term of this patent is extended or adjusted under 35 U.S.C. 154(b) by 504 days.

(21) Appl. No.: 10/030,576

(22) PCT Filed: Jul. 7, 2000

(86) PCT No.: PCT/DE00/02186

§ 371 (c)(1),
(2), (4) Date: May 15, 2002

(87) PCT Pub. No.: WO01/04486

PCT Pub. Date: Jan. 18, 2001

(30) Foreign Application Priority Data

Jul. 8, 1999 (DE) ..... 199 31 822

(51) Int. Cl.
*F02M 59/00* (2006.01)
*F02M 39/00* (2006.01)
*B05B 1/30* (2006.01)

(52) U.S. Cl. ..... 239/533.2; 239/533.3; 239/585.1; 239/585.3; 239/585.5; 239/900

(58) Field of Classification Search ..... 239/533.2, 239/533.3, 533.8, 533.9, 533.11, 533.13, 239/533.14, 585.1, 585.3, 585.4, 585.5, 900, 239/88–92; 251/129.15, 129.21
See application file for complete search history.

(56) References Cited

U.S. PATENT DOCUMENTS 3,982,693 A * 9/1976 Hulsing ..... 239/88
5,341,994 A * 8/1994 Wakeman ..... 239/585.5
5,452,574 A * 9/1995 Cowell et al. ..... 60/39.23
5,544,816 A * 8/1996 Nally et al. ..... 239/585.5
5,769,328 A * 6/1998 Zdyb et al. ..... 239/585.4
5,979,803 A * 11/1999 Peters et al. ..... 239/533.4
6,053,425 A * 4/2000 Stringfellow ..... 239/124

FOREIGN PATENT DOCUMENTS

| | | |
|---|---|---|
| DE | 20 64 554 | 8/1972 |
| DE | 27 55 400 | 6/1979 |
| DE | 38 43 862 | 6/1990 |

* cited by examiner

*Primary Examiner*—Davis Hwu
(74) *Attorney, Agent, or Firm*—Kenyon & Kenyon

(57) ABSTRACT

A fuel injection valve for fuel injection valve systems of internal combustion engines is described, having an energizable actuating element, a valve closing element which is axially movable along a valve longitudinal axis and which works in conjunction with a rigid valve seat that is provided on a valve seat element so as to open and close the valve, and at least one exit opening that is provided downstream from the valve seat. As the injection valve is of the inward-opening type, the opening movement of the valve closing element is oriented away from the exit opening and the closing movement of the valve closing element is oriented toward the exit opening. Fuel flows completely through the interior of the valve closing element, and the valve seat element has an inner trough-shaped recess, so that the opening movement of the valve closing element is fuel-pressure-assisted, due to a flow inversion upstream of the valve seat.

14 Claims, 1 Drawing Sheet

FUEL INJECTION VALVE

FIELD OF THE INVENTION

The present invention relates to a fuel injection valve.

BACKGROUND INFORMATION

According to German Published Patent Application No. 27 55 400, an electromagnetic fuel injector which can be used in fuel injection systems of internal combustion engines is known. This fuel injector is characterized by relatively short injection times. The fuel injector is designed in such a way that the entire pressure drop basically occurs through injection holes located downstream of a valve seat which interact with a sphere-shaped valve closing element. The valve closing element is located in a dead area between the valve seat and the injection holes opening in the direction of the fuel flow. When the valve is closed, the valve closing element is pressed against the valve seat with the help of a plunger. The plunger has the same diameter as the valve seat, and system pressure of the fuel is constantly applied to it in the direction of the closing movement. The fuel is supplied through a channel in the valve housing, away from the plunger, to the valve closing element from below which can thus complete the opening movement by lifting from the valve seat.

According to German Published Patent Application No. 38 43 862, an electromagnetically actuatable valve as a fuel injection valve, which is embodied as an inward-opening injection valve, is known heretofore. The valve is actuated by an energizable electromagnet, a sphere-shaped valve closing element interacting with a rigid valve seat in order to open and close the valve. If current is supplied to the magnet coil of the electromagnet, a starting movement is produced via an armature that is attached to an axially movable valve needle, this raising the valve closing element—which also belongs to the valve needle—off the valve seat so that the valve is opened. Herein, the connecting element of the valve needle, which is arranged between the armature and the valve closing element, is resilient and elastic.

As is the case with all inward-opening fuel injection valves, the direction of flow of the fuel at the valve seat is the same as the closing movement of the valve closing element, i.e., the valve needle. When the valve is in the closed position, the fuel is present on the upstream side of the valve seat at a pressure that acts in the valve's closing direction so that when the valve opens the fuel acts against the valve needle's opening direction.

SUMMARY OF THE INVENTION

The fuel injection valve according to the present invention has the advantage that it is manufacturable in an especially straightforward and inexpensive manner. It is advantageous that only a small number of individual components are required and are in themselves very straightforward to manufacture, and may subsequently be assembled in a straightforward manner. The fuel injection valve according to the present invention is easy to handle during assembly, as insertion of all the components into one another is simplified. Just two rigid, pressure-tight connections are required to guarantee problem-free functioning of the injection valve.

It is particularly advantageous that the valve closing element and the valve seat element are designed so that when the actuating element is energized, the valve closing element's opening movement is fuel-pressure-assisted, because system pressure is present on the downstream side of the valve closing element when the valve is in the closed position. The valve is designed so that a hydraulic opening force is generated, so that, for example, an end stage required for triggering may be operated using less energy than is normally the case, and as a result the injection valve may be operated using less inrush current. In addition, it is advantageous that the injection valve switching times are shortened.

When the injection valve opens, thanks to the design of the valve closing element and the valve seat element according to the present invention, there is no underpressure in the volume of fuel downstream from the tight seat, as the movement of the needle does not cause any increase in volume. As a result, the small quantity linearity and the atomization at the start of injection may be significantly improved relative to known valves in which the volume increases during opening due to the needle movement.

It is advantageous that the valve closing element is connected rigidly and in a pressure-tight manner to a needle sleeve through the inside of which fuel flows. At the opposite end from the valve closing element, the needle sleeve is connected rigidly and in a pressure-tight manner to a valve housing, the valve closing element's axial movement being possible thanks to the fact that a section of the needle sleeve is resilient and elastic. Herein it is advantageous if the needle sleeve performs its function of a pressure spring via a screw-shaped, pleated spring section.

Thanks to the low moved mass of the needle sleeve and of the valve closing element, the injection valve may be opened and closed quickly so that the injection valve switching times may be shortened even further.

It is advantageous that an atomizer disk may be integrated very easily into the valve housing downstream from the valve seat, as radial inflow into an atomization disk of this kind is facilitated by the design of the valve seat element and the associated flow guidance.

Thanks to the design of the pressure-balanced valve component according to the present invention that includes a needle sleeve and a valve closing element, and thanks to the low mass of this valve component, a relatively small magnet circuit may be used, and as a result the dimensions of the injection valve as a whole may be kept small.

DETAILED DESCRIPTION

Figure 1:
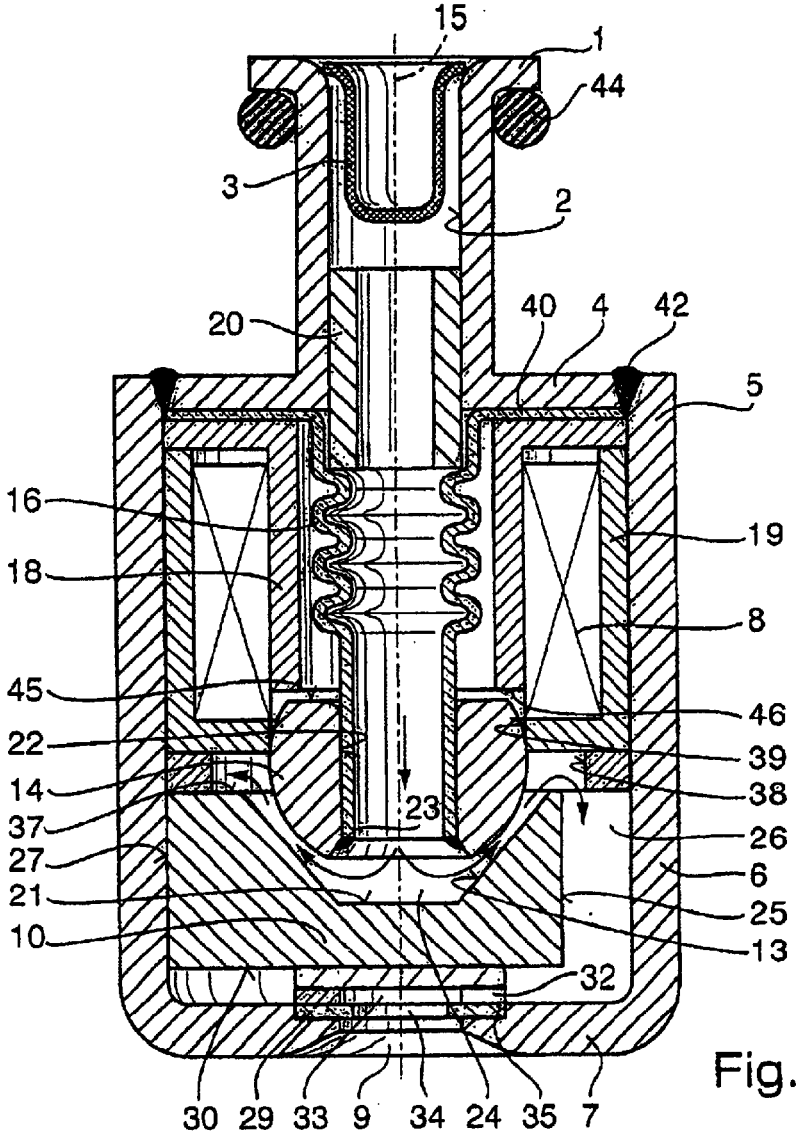
FIG. 1 shows a section through an inward-opening fuel injection valve.

The fuel injection valve shown in FIG. 1 by way of an example is an inward-opening injection valve which is particularly suitable as a high-pressure injection valve for injecting fuel directly into the combustion chamber of a gas-mixture compressing, spark-ignition internal combustion engine.

The fuel injection valve is embodied as a top-feed injection valve, which means an upper inflow-side end of the injection valve is located at the opposite end from a lower injection-side end of the injection valve. The inflow-side end of the injection valve forms a tube-shaped connection nozzle 1. A fuel filter 3, through which the fuel passes, is provided in a flow opening 2 of connection nozzle 1.

In the area of a shoulder 4, which extends radially, connection nozzle 1 is rigidly connected to a sleeve-shaped valve housing 5, connection nozzle 1 ultimately also constituting part of the valve housing. Valve housing 5 has casing section 6 and a base section 7. In base section 7, for example, a central exit opening 9, via which the fuel is injected directly into a combustion chamber, is provided.

The fuel injection valve is actuated electromagnetically, for example. To accomplish this, a magnet coil 8 is arranged inside valve housing 5, the coil area for holding magnet coil 8 being radially delimited on the outside by casing section 6 of valve housing 5 and at the top by shoulder 4 of connection nozzle 1.

Valve housing 5, as the valve seat carrier, also bears a valve seat element 10. Valve seat element 10 has a, for example, truncated-cone-shaped valve seat surface 13 in conjunction with which a partial-sphere-shaped closing element 14 functions to form a tight seat. When the injection valve is in the non-energized state, valve closing element 14 lies tightly against valve seat surface 13 so that the valve is in the closed state. In FIG. 1, the injection valve is shown in the energized state in which valve closing element 14 is in a position in which it is raised off valve seat surface 13.

The electromagnetic circuit having magnet coil 8, a first inner terminal component 18, a second outer terminal component 19, and valve closing element 14 which also functions as an armature, is used to axially move valve closing element 14 along a valve longitudinal axis 15 and thus to open the injection valve against the spring load imparted by a needle sleeve 16, which is embodied as a concertina and is rigidly attached to valve closing element 14, and to close it. Needle sleeve 16 does not constitute an axially movable valve needle in the conventional sense, as it is designed as a resilient component which, at the end located opposite valve closing element 14, is rigidly attached to valve housing 5 and to connection nozzle 1.

The fuel that passes through connection nozzle 1 and fuel filter 3 flows further downstream through an inner opening of an adjustment sleeve 20, which is used to adjust the spring load imparted by needle sleeve 16, which functions as a return spring so as to close the injection valve. To accomplish this, adjustment sleeve 20, which is, for example, pressed into connection nozzle 1, is in direct contact with a pleat of casing 16. The fuel then flows through needle sleeve 16 in the axial direction until it reaches valve closing element 14, which has an inner through-hole 22. Needle sleeve 16, which in the area of valve closing element 14 is no longer pleated but rather cylindrical, axially almost completely penetrates through-hole 22, for example, and is rigidly connected to valve closing element 14 at the end facing exit opening 9, it being possible to create the rigid and tight connection via a circumferential welded seam 23, which is created using a laser. Alternatively, needle sleeve 16 and valve closing element 14 may be adhesively bonded or soldered to one another so that they are pressure-tight. It is also feasible to create a press-type fit between both components 14 and 16 by providing a stop shoulder on needle sleeve 16 as far as which valve closing element 14 may be pressed on.

Downstream from through-hole 22 of valve closing element 14, fuel gathers in a hollow space 24 of valve seat element 10 that is formed by a trough-shaped recess 21 in which truncated-cone-shaped valve seat surface 13 tapers. Starting from hollow space 24, if the injection valve is open flow passes through the narrow gap that is formed between valve closing element 14 and valve seat surface 13. In this flow area an at least partial fuel flow inversion is present, because in addition to a radial flow component an axial flow component, which is in the opposite direction to the axial direction of flow from connection nozzle 1 to hollow space 24, is present, as indicated by the arrows in the area of the tight seal. In this way injection valve opening procedures that are assisted by the fuel pressure and the fuel flow direction may be achieved.

Figure 2:
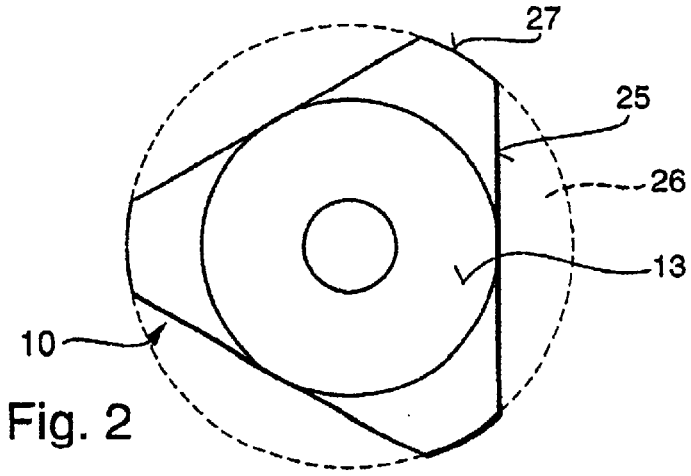
FIG. 2 shows a top view of a valve seat element.

In the radial direction, fuel flows up to at least one, e.g., three flattened parts 25 provided on the outer circumference of valve seat element 10 which, as surfaces that have been ground flat, form flow channels 26 between themselves and casing section 6 of valve housing 5. FIG. 2 shows a top view of a valve seat element 10 of this kind, as an individual component. Thanks to its three flattened parts 25, valve seat element 10 is largely trihedral in shape, transition areas 27, which are at 120° respectively from one another, having, at the circumference of valve seat element 10, a circular-shaped outer contour between flattened parts 25. Transition areas 27 allow valve seat element 10 to be centered in valve housing 5.

The fuel passes axially through flow channels 26 and then passes, for example, into an atomization disk 29, through which the fuel flows radially, and which is clamped between a lower side 30 of valve seat element 10 and base section 7 of valve housing 5. In FIG. 1, a tri-layer atomization disk 29 manufactured via, for example, multi-layer electrodeposition, is schematically shown. This atomization disk 29 has, for example, a plurality of swirl channels 32 in a middle level which open into a central swirl chamber 33. The fuel to which swirl is imparted in this way exits from an outlet opening 34 of atomization disk 29 that is provided in a lower level. Herein, in outlet opening 34 the fuel is mainly concentrated near the wall, while an air core is formed in the center. Thus the film of liquid, which exits in the form of a complete ring, spreads out into the shape of a hollow cone in space. Injection hole disks and atomization disks having completely different designs and different manufacturing methods may be used instead of multi-layer swirl disks.

Below, we describe the assembly process for the fuel injection valve in greater detail. Atomization disk 29 is inserted into valve housing 5 and into a recess 35 of base section 7 that is provided for this purpose. After that, valve seat element 10 is pressed into valve housing 5. Lower side 30 of valve seat element 10 rests on atomization disk 29 and thus defines the height of the radial inflow area for atomization disk 29. A spacer disk 38, which is only in contact with valve seat element 10 in three transition areas 27, is placed on upper side 37 of valve seat element 10. Spacer disk 38 is embodied so as to have a specific thickness so that the stroke of valve closing element 14 is set as required. Flow channels 26 are covered by spacer disk 38 in their outer areas so that the fuel may flow unhindered into them.

Next, second terminal component 19, which constitutes a magnet yoke having an L-shaped cross-section, is pressed into valve housing 5 until it rests against spacer disk 38. Then magnet coil 8 is inserted into terminal component 19. Terminal component 19 has, on the arm that extends radially, a guide opening 39 which guides valve closing element 14 during its axial movement. After that, the valve part, which includes needle sleeve 16 and valve closing element 14, and first terminal component 18, which as a magnet yoke also has an L-shaped cross section, are inserted into valve housing 5.

Needle sleeve 16 is manufactured, for example, via deep drawing using spring steel. The pleats of needle sleeve 16 that create the spring action are produced by introducing a forming tool, which resembles a screw and whose thread is brought into contact with the inner wall of the sleeve, into the sleeve. If the ambient pressure is increased in a pressure chamber and the inside of the sleeve has been sealed off against the overpressure, the sleeve implodes and takes on the outer shape of the screw-type tool. The tool may then be withdrawn from needle sleeve 16 by rotating it like a screw. Alternatively the casing may be manufactured via plastic injection molding, in which case the plastic is to have elasticity that remains constant over a prolonged period. Needle sleeve 16 performs the function of a pressure spring which in the non-energized state presses valve closing element 14 against valve seat surface 13 and thus into the injection valve's closed position. Despite its small wall thickness and thus small weight, needle sleeve 16 is very stable and rigid against the fuel pressure that is present inside thanks to its pleated, screw-type design.

First terminal component 18 is pressed into valve housing 5 until it rests on second terminal component 19. As a result, magnet coil 8 is surrounded in all directions by two terminal components 18, 19. Needle sleeve 16 rests via a bent sleeve end 40 on first terminal component 18. Next, connection nozzle 1 is placed on this pre-assembled valve part, its shoulder 4 resting on sleeve end 40 and indirectly on first terminal component 18. After that, valve housing 5 and connection nozzle 1 are rigidly and tightly connected to one another by creating a welded seam 42. Welded seam 42 is created so that needle sleeve 16 is also connected to connection nozzle 1 via a pressure-tight connection. Once this attachment has been created, adjustment sleeve 20 is inserted into connection nozzle 1. Then fuel filter 3 is inserted and a sealing ring 44 is placed over connection nozzle 1.

When the injection valve is in the closed position, needle sleeve 16 presses valve closing element 14 against valve seat surface 13. Upstream from the tight seat, the fuel is under system pressure. The fuel hollow areas downstream from the tight seat are filled with fuel that is not subject to pressure. Sealing of the pressureless area relative to the area to which pressure is applied is accomplished via the pressure-tight connection of needle sleeve 16 to valve closing element 14 and to connection nozzle 1. The clamping area between valve housing 5, valve seat element 10 and atomization disk 29 does not have to be absolutely pressure-tight, as pressure is only present when the injection valve is open and in that case the flow takes the direct path through the flow openings in atomization disk 29 due to the low flow resistance.

Partial-sphere-shaped valve closing element 14 has, on the side facing away from valve seat surface 13, a polished frontal surface 45 which extends perpendicular to valve longitudinal axis 15. When current flows into magnet coil 8, valve closing element 14, which functions as an armature, is drawn from valve seat surface 13 as far as a stop surface 46 that is provided on first terminal component 18. Thus the path between the two end positions (stop surface 46 and valve seat surface 13) of valve closing element 14 constitutes the stroke. It is possible to influence the stroke by varying the thickness of spacer disk 38. When the injection valve opens, no underpressure arises in the volume of fuel downstream from the tight seat, as the movement of the needle does not result in any increase in volume. As a result, the small quantity linearity and the atomization may be improved relative to known valves in which, during opening, movement of the needle causes an increase in volume. Thanks to the low moved mass of needle sleeve 16 and of valve closing element 14, the injection valve may be opened and closed quickly.

In summary, the fuel injection valve according to the present invention has a valve closing element 14 through the inside of which fuel flows. As a result, fuel close to valve longitudinal axis 15 reaches the downstream end of valve closing element 14 so that when the valve is in the closed position system pressure is present at the downstream side of valve closing element 14 directly upstream from valve seat 13. No hydraulic closing load is present on the upstream side of valve closing element 14, e.g., in the area of frontal surface 45. As a result of this hydraulic pressure distribution, a hydraulic opening force is generated, thanks to which the valve opening procedure is fuel-pressure-assisted. The flow inversion in hollow space 24 having a flow orientation directly upstream valve seat 13 and having a flow component that acts in the axial direction, i.e., in the direction of opening of the valve, creates further assistance for the opening movement of valve closing element 14. Valve seat element 10 may also be embodied as a flat seat so that fuel flows only radially outward from valve closing element 14 through the inside of which the fuel flows, there being no axial flow component. The opening movement of valve closing element 14 is fuel-pressure-assisted in this case too, because when the valve is in the closed position system pressure is present at the underside of valve closing element 14 upstream of valve seat 13.

What is claimed is:

1. A fuel injector for a fuel injection system of an internal combustion engine, comprising:

an energizable actuating element;

a valve seat element;

a rigid valve seat provided on the valve seat element; and a valve closing element that is axially movable along a valve longitudinal axis and that works in conjunction with the rigid valve seat so as to open and close a valve, wherein:

at least one outlet opening is provided downstream from the rigid valve seat, the valve closing element and the valve seat element being designed so that an opening movement of the valve closing element is fuel-pressure-assisted, wherein:

the opening movement of the valve closing element is directed away from the at least one outlet opening, a closing movement of the valve closing element is directed toward the at least one outlet opening, and the valve closing element has an inner through hole through which a fuel flows in a direction that is opposite to the opening movement of the valve closing element, the valve closing element and the valve seat element configured to reverse the direction of fuel flow between the through hole of the valve closing element and the at least one outlet opening.

2. The fuel injector according to claim 1, wherein:

upstream from the rigid valve seat, between the valve closing element and the valve seat element, a hollow space is formed, from which the fuel flows toward the rigid valve seat, the flowing fuel having a radial, outward flow component.

3. The fuel injector according to claim 1, wherein:

upstream from the rigid valve seat, between the valve closing element and the valve seat element, a hollow space is formed, from which the fuel flows toward the rigid valve seat, the flowing fuel having a radial flow component and an axial flow component in a direction of the opening movement of the valve closing element.

4. The fuel injector according to claim 1, wherein:

the valve closing element is partial-sphere-shaped.

5. The fuel injector according to claim 1, further comprising:

a needle sleeve through which the fuel flows and to which the valve closing element is rigidly connected in a pressure-tight manner.

6. The fuel injector according to claim 1, wherein:

the valve seat element includes a middle trough-shaped recess that is adjacent to a truncated-cone-shaped valve seat surface of the rigid valve seat in the direction of flow.

7. The fuel injector according to claim 6, wherein:

the valve seat element has no inner flow openings, so that an axial fuel flow path in a direction of the at least one outlet opening is embodied exclusively at an outer periphery of the valve seat element.

8. The fuel injector according to claim 7, wherein:

the valve seat element includes a non-circular outer contour having at least one flattened part that creates the axial fuel flow path.

9. The fuel injector according to claim 8, wherein:

the valve seat element is largely trihedral in shape and includes three flattened parts.

10. The fuel injector according to claim 1, wherein:

the valve seat element is embodied as a flat seat.

11. The fuel injector according to claim 1, the through hole of the valve closing element is arranged so that in an open position of the valve closing element, the fuel flows inside the valve closing element past a plane of contact that is defined between the valve closing element and the sealing seat with the valve closing element in a closed position and thereafter passes a line of contact between the valve closing element and the sealing seat at the periphery of the valve closing element.

12. A fuel injector for a fuel injection system of an internal combustion engine, comprising:

an energizable actuating element;

a valve seat element;

a rigid valve seat provided on the valve seat element; and a valve closing element that is axially movable along a valve longitudinal axis and that works in conjunction with the rigid valve seat so as to open and close a valve;

wherein at least one outlet opening is provided downstream from the rigid valve seat, the valve closing element and the valve seat element being designed so that an opening movement of the valve closing element is fuel-pressure-assisted;

wherein the opening movement of the valve closing element is directed away from the at least one outlet opening;

wherein a closing movement of the valve closing element is directed toward the at least one outlet opening;

wherein the valve closing element has an inner through hole through which a fuel flows in a direction that is opposite to the opening movement of the valve closing element;

the fuel injector further comprising a needle sleeve through which the fuel flows and to which the valve closing element is rigidly connected in a pressure-tight manner;

wherein the needle sleeve at least partially penetrates and is attached to the inner through hole of the valve closing element.

13. A fuel injector for a fuel injection system of an internal combustion engine, comprising:

an energizable actuating element;

a valve seat element;

a rigid valve seat provided on the valve seat element; and a valve closing element that is axially movable along a valve longitudinal axis and that works in conjunction with the rigid valve seat so as to open and close a valve;

wherein at least one outlet opening is provided downstream from the rigid valve seat, the valve closing element and the valve seat element being designed so that an opening movement of the valve closing element is fuel-pressure-assisted;

wherein the opening movement of the valve closing element is directed away from the at least one outlet opening;

wherein a closing movement of the valve closing element is directed toward the at least one outlet opening;

wherein the valve closing element has an inner through hole through which a fuel flows in a direction that is opposite to the opening movement of the valve closing element;

the fuel injector further comprising a needle sleeve through which the fuel flows and to which the valve closing element is rigidly connected in a pressure-tight manner; the fuel injector further comprising a valve housing to which the needle sleeve is attached rigidly and in a pressure-tight manner at an end opposite the valve closing element, wherein:

a section of the needle sleeve is resilient and elastic, and an axial movement of the valve closing element is enabled by the section of the needle sleeve that is resilient and elastic.

14. The fuel injector according to claim 13, wherein:

the section of the valve needle that is resilient and elastic is pleated in a helical manner.

* * * * *